US005944651A

United States Patent [19]

Koch

[11] Patent Number: 5,944,651

[45] Date of Patent: Aug. 31, 1999

[54] INCUBATOR WITH DIFFERENTLY TEMPERED ZONES

[75] Inventor: Jochim Koch, Ratzburg, Germany

[73] Assignee: Drager Medizintechnik GmbH, Luebeck, Germany

[21] Appl. No.: 09/100,908

[22] Filed: Jun. 19, 1998

[30] Foreign Application Priority Data

Feb. 12, 1998 [DE] Germany ..... 198 05 654

[51] Int. Cl.[6] ..... A61G 11/00

[52] U.S. Cl. ..... 600/22

[58] Field of Search ..... 600/21–22; 128/202.12, 128/205.26

[56] References Cited

U.S. PATENT DOCUMENTS 5,385,529 1/1995 Koch ..... 600/22
5,792,041 8/1998 Kobayashi et al. ..... 600/22
5,817,003 10/1998 Moll et al. ..... 600/22

FOREIGN PATENT DOCUMENTS 40 08 822 A1 9/1991 Germany .

*Primary Examiner*—Samuel Gilbert
*Attorney, Agent, or Firm*—McGlew and Tuttle, P.C.

[57] ABSTRACT

An incubator with air supply, in which air feed ducts, through which a gas flow heated by a tempering device is introduced ascendingly into the interior space of the incubator, are present on the longitudinal sides of a lying surface. Different temperature zones can be set along the lying surface with the gas flow divided into at least one first gas flow and a second gas flow. Air feed ducts extending along the lying surface (2) are provided as first air feed ducts (11) with a first tempering device (6) and as second air feed ducts (13) with a second tempering device (7). The first air feed ducts (11) and the second air feed ducts (13) are arranged, extending over predetermined sections of the lying surface (2), along the lying surface.

8 Claims, 3 Drawing Sheets

INCUBATOR WITH DIFFERENTLY TEMPERED ZONES

FIELD OF THE INVENTION

The present invention pertains to an incubator with an air supply, which takes place via air feed ducts arranged on the longitudinal sides of a lying surface such that a gas flow heated by a tempering device is introduced ascendingly into the interior space of the incubator.

BACKGROUND OF THE INVENTION

The question of whether the brain of an infant (premature or newborn baby) should be treated at a lower temperature than the rest of the body has been increasingly discussed during the past few years. Clinical studies show that in the case of neurological damage to the brain the cooler temperature helps to heal the injury or to better overcome it. The cooler temperature helps to prevent possible damage to the brain in the case of possible disturbances in perfusion and blood supply.

In an incubator known from DE 40 08 822 A1, air is drawn in from the interior space of the incubator and is ascendingly returned into the interior space of the incubator via air feed ducts extending along the lying surface after humidification and heating. The air feed ducts are arranged on all sides of the lying surface, so that a warm air bell, with which optimal temperature constancy is achieved above the lying surface, is formed above the lying surface.

SUMMARY AND OBJECTS OF THE INVENTION

The primary object of the present invention is to improve an incubator of this type such that different temperature zones can be set along the lying surface.

According to the invention, an incubator is provided with air supply, which takes place via air feed ducts arranged on the longitudinal sides of a lying surface such that a gas flow heated by a tempering device is introduced ascendingly into the interior space of the incubator. The gas flow is divided into at least one first gas flow and a second gas flow. The air feed ducts extend along the lying surface and are designed as first air feed ducts associated with the first gas flow with a first tempering device and as second air feed ducts associated with the second gas flow with a second tempering device. The first air feed ducts and the second air feed ducts are arranged extending along the lying surface over predetermined sections of the lying surface. The tempering devices are designed as tempering devices adjustable to different temperatures.

A process is also provided for tempering the interior space of an incubator. Air feed ducts, through which a tempered gas flow is introduced ascendingly into the interior space of the incubator on both sides of the lying surface, are present on the longitudinal sides of a the lying surface. The gas flow is divided into at least one first gas flow and a second gas flow. The gas flows are tempered individually with the tempering devices associated with the gas flows. The gas flows extend over predetermined longitudinal sections of the lying surface and are allowed to enter the incubator interior space.

The advantage of the present invention is essentially that by dividing the gas flow returned into the interior space of the incubator into two separate gas flows, heating the gas flows with tempering devices individually associated with the gas flows, and introducing the gas flows via separate air feed ducts extending on the longitudinal side of the lying surface, a temperature profile can be set along the lying surface. The air feed ducts, which are designed as first air feed ducts and as second air feed ducts, have discharge openings, which surround the longitudinal sides of the lying surface in a U-shaped pattern in sections. The air is discharged from the air feed ducts on both sides of the lying surface, and it then rises first vertically upward in parallel to the wall of the incubator hood and is then deflected back to the lying surface on the top side of the incubator hood. Two so-called flow cylinders are thus formed along the lying surface, and they determine the climate above the lying surface. Since the flow cylinders are composed of two gas flows in the longitudinal direction, which are passed over different tempering devices, two different temperature zones, which can be used for therapeutic purposes, can be set in the longitudinal direction of the lying surface.

An even finer graduation of the temperature is obtained if the gas flow returned into the interior space of the incubator is divided into a plurality of individual gas flows, with each of which a separate tempering device is associated. The gas flows are then introduced into the interior space of the incubator in a serial succession along the lying surface.

The first air feed ducts advantageously extend beginning from the middle of the lying surface to the head end, whereas the second air feed ducts extend from the middle of the lying surface to the foot end.

The tempering devices of the gas flows are advantageously designed as Peltier elements. Peltier elements offer the advantage for this application that the gas flow can be both heated and cooled with them. It is thus possible to definitely maintain the head area of the lying surface at a lower temperature, while the rest of the lying surface is heated.

It is especially advantageous to arrange temperature sensors in the area of the first air feed ducts and of the second air feed ducts, with which sensors the temperature of the individual gas flows is determined in order to then set the gas temperatures in a control circuit such that the predetermined temperature profile will be obtained.

It is advantageous for certain applications to arrange the temperature sensors at the head and foot ends of an infant located on the lying surface rather than within the interior space of the incubator.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
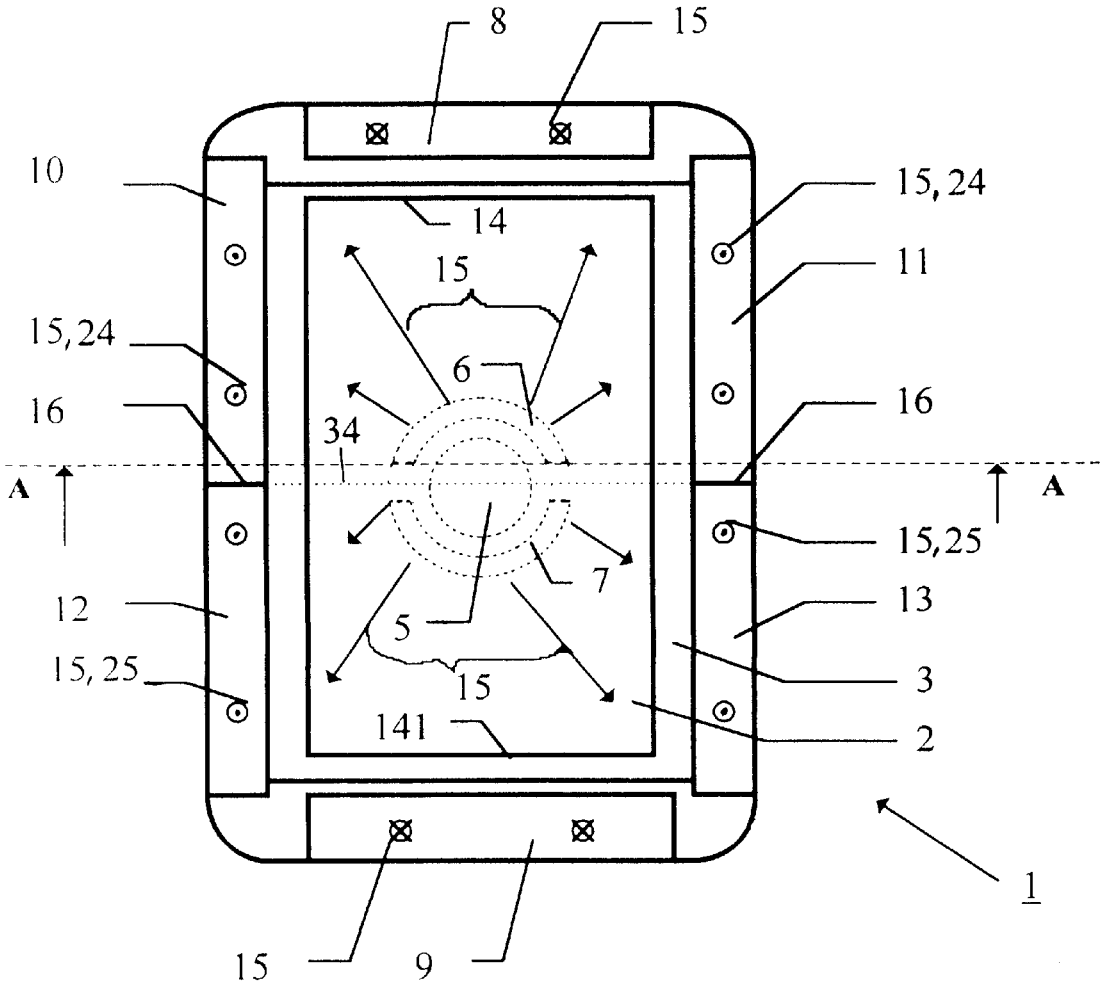
FIG. 1 is a top view of an incubator according to the invention.

Referring to the drawings in particular, FIG. 1 shows a top view of an incubator 1 with a rectangularly designed lying surface 2 for receiving an infant, not shown in FIG. 1. The lying surface 2 lies on an intermediate bottom 3 of the incubator 1. A fan wheel 5 driven by an electric motor 4, FIG. 2, a first tempering device 6, and a second tempering device 7 are located under the intermediate bottom 3. The air in the incubator 1 is circulated essentially in a closed circuit, wherein the fan wheel 5 draws in the air via suction ducts 8, 9 on the front sides of the lying surface 2, and delivers a first gas flow 24 to first air feed ducts 10, 11 via the first tempering device 6 and a second gas flow 25 to second air feed ducts 12, 13 via the second tempering device 7. The air delivery direction is illustrated by arrows 15 for greater clarity. The air feed ducts 10, 11 are separated from the second air feed ducts 12, 13 by a partition 16, so that only a slight mixing of the gas flows 24, 25 with each other takes place. The first air feed ducts 10, 11 extend from the head end 14 of the lying surface to the middle 34, and the second air feed ducts 12, 13 are located between the middle 34 of the lying surface and the foot end 141.

Figure 2:
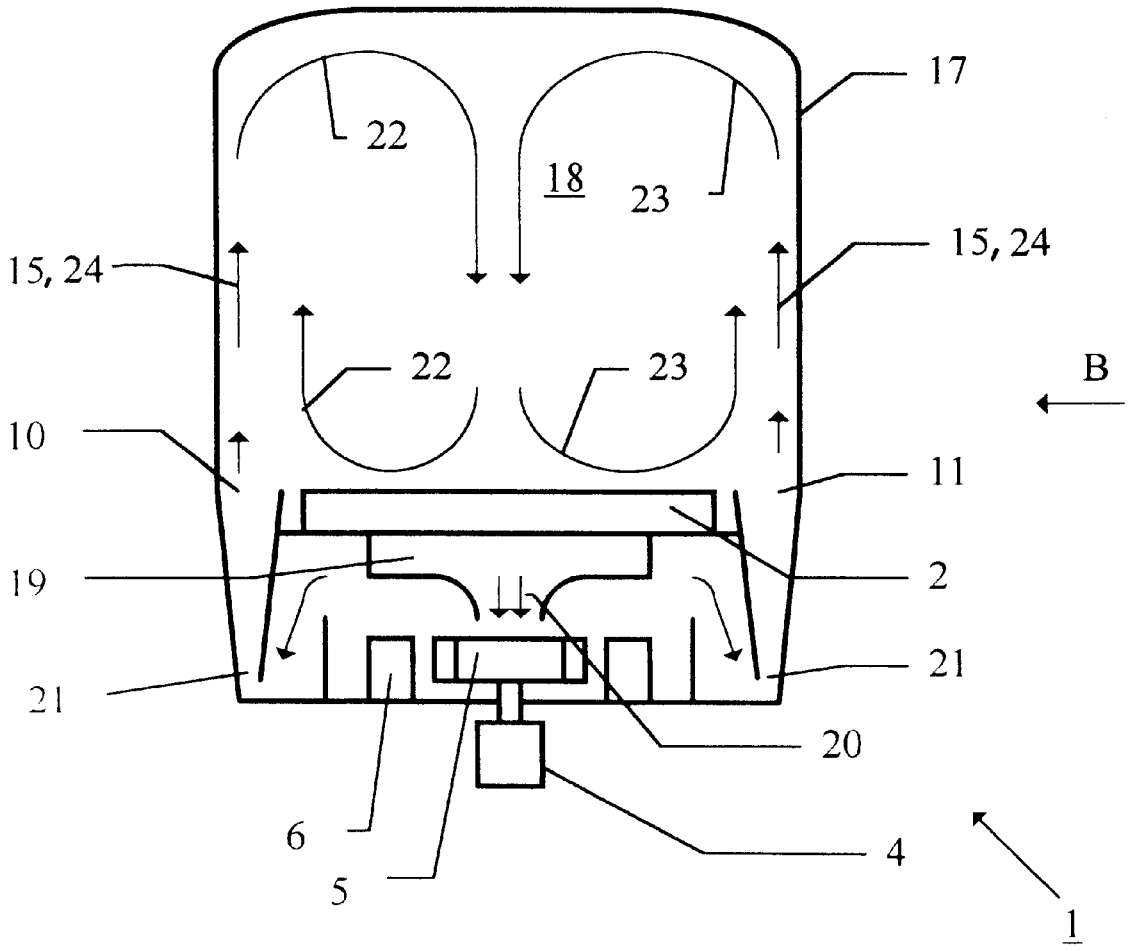
FIG. 2 is a longitudinal sectional view of the incubator along the sectional line A—A according to FIG. 1.

FIG. 2 shows the longitudinal view of the incubator 1 according to FIG. 1 along the sectional line A—A. Identical components are designated with the same reference numbers as in FIG. 1. The guiding of air within the incubator interior space 18 surrounded by the incubator hood 17 is illustrated in FIG. 2. The air drawn in via the suction ducts 8, 9 first enters a collection duct 19, which extends along the lying surface 2 and has an intake opening 20 above the fan wheel. Slots 21, via which the air drawn in enters the air feed ducts 10, 11, 12, 13, are located on the two longitudinal.sides of the lying surface 2. Free air jets, which form flow cylinders 22, 23 within the incubator hood 17, are generated by the slots 21. These flow cylinders 22, 23 extend almost uniformly over the entire length of the lying surface 2 extending from the head end 14 to the foot end 141. If the tempering devices 6, 7 are set at different temperatures, different temperature levels will become established in the area of the first air feed ducts 10, 11 and in the area of the second air feed ducts 12, 13, as a result of which different temperature zones will become established along the lying surface 2. If, e.g., the first temperature device 6 is set at a temperature that is below the temperature of the second tempering device 7, the section of the lying surface 2 surrounded by the first air feed ducts 10, 11 will be cooled, while the section surrounded by the second air feed ducts 12, 13 will be heated. The upper part of the body of an infant lying on the lying surface 2, who is not shown in FIGS. 1 and 2, can thus be cooled, while the other parts of the body are heated.

Figure 3:
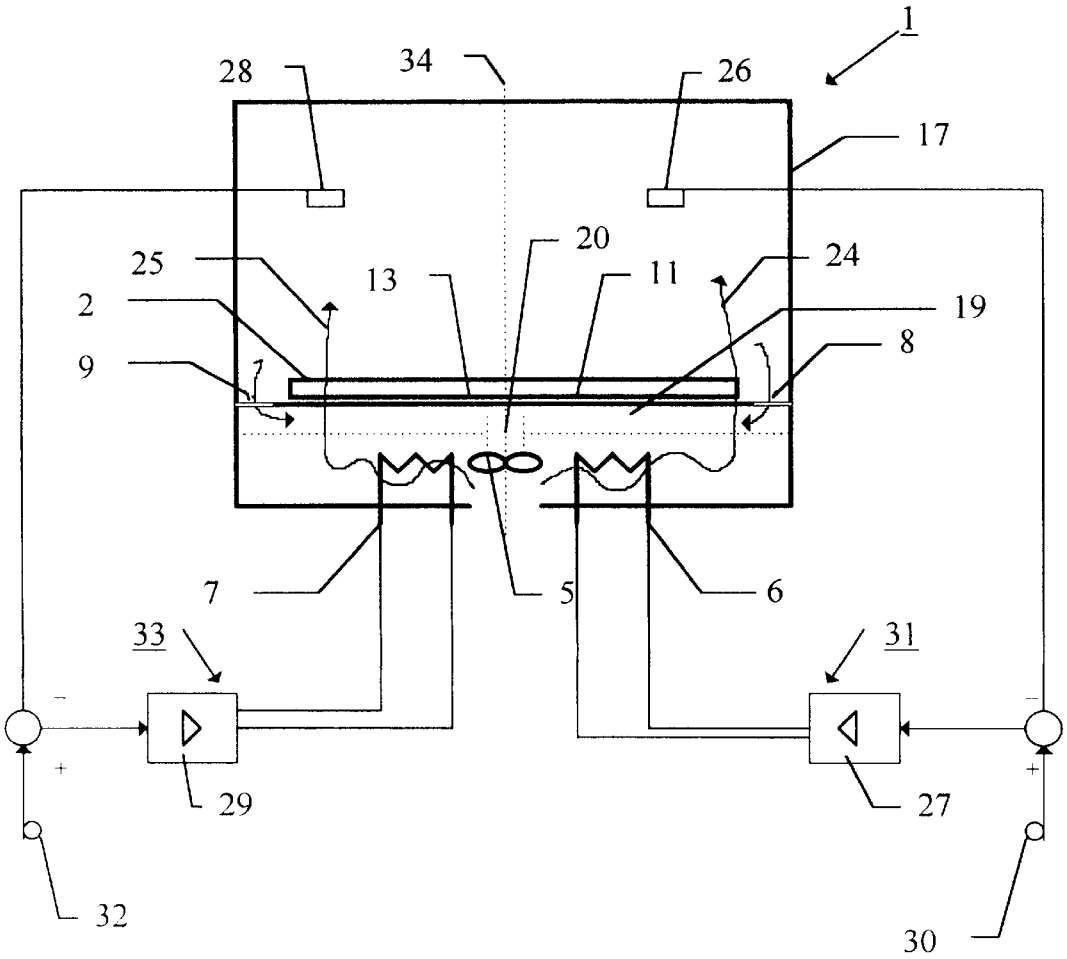
FIG. 3 is a schematic side view of the incubator according to FIG. 1 in the direction of view B according to FIG. 2.

FIG. 3 schematically shows a view of the incubator 1 in FIG. 1 in the direction of view B according to FIG. 2. Identical components are designated with the same reference numbers as in FIGS. 1 and 2. The air drawn in via the suction openings 8, 9 by the fan wheel 5 is divided into two gas flows, wherein the first gas flow 24 is sent to the first air feed ducts 10, 11 via the first tempering device 6, while the second gas flow 25 reaches the second air feed ducts 12, 13 via the second tempering device 7. Only the air feed ducts 11, 13 are shown in FIG. 3 for greater clarity. A first temperature sensor 26, which is connected to the first tempering device 6 via a first temperature controller 27, is located above the lying surface 2 in the area of the first air feed ducts 10, 11. A second temperature sensor 28 is correspondingly arranged in the area of the second air feed ducts 12, 13, and it is connected to the second tempering device 7 via a second temperature controller 29. The first temperature sensor 26, the first temperature controller 27, the first tempering device 6, and a first temperature set point setter 30 together form a first temperature control circuit 31, and the second temperature sensor 28, the second temperature controller 29, and the second tempering device 7 together with a second set point setter 32 form a second temperature control circuit 33. The temperature of the gas flows 24, 25 can be set individually with the temperature set point setters 30, 32. The boundary between the gas flows 24, 25 is located in FIG. 3 approximately in the middle 34 of the lying surface, which coincides with the middle 34 of the incubator hood 17.

While a specific embodiment of the invention has been shown and described in detail to illustrate the application of the principles of the invention, it will be understood that the invention may be embodied otherwise without departing from such principles.

What is claimed is:

1. An incubator, comprising:

a lying surface;

a first tempering device;

first air feed ducts for a first gas flow associated with said first tempering device;

a second tempering device;

second air feed ducts for a second gas flow associated with said second tempering device, said first air feed ducts and said second air feed ducts being at longitudinal sides of said lying surface and said first air feed ducts and said second air feed ducts being arranged extending along said lying surface over predetermined sections of said lying surface, wherein said tempering devices are designed as tempering devices adjustable to different temperatures.

2. The incubator in accordance with claim 1, wherein said first air feed ducts extend in a section from a head end to a middle of said lying surface, and said second feed ducts extend in a section beginning approximately from said middle of said lying surface to a foot end.

3. The incubator in accordance with claim 1, wherein Peltier elements are provided as said tempering devices.

4. The incubator in accordance with claim 1, further comprising:

a first temperature sensor for detecting the temperature of the air being discharged from said first air fed ducts, said first temperature sensor being provided downstream of said air feed ducts; and a second temperature sensor for detecting the temperature of the air being discharged from said second air feed ducts, said second temperature sensor being provided downstream of said second air feed ducts.

5. The incubator in accordance with claim 4, wherein said temperature sensors are positionable on a body of an infant lying on said lying surface.

6. The incubator in accordance with claim 4, further comprising:

a first temperature control circuit connected with said first temperature sensor acting as an actual value transducer with a first temperature controller acting as a final control element of said first tempering device; and a second temperature control circuit connected to said second temperature sensor acting as an actual value transducer and with a second temperature controller acting as a final control element of said second tempering device.

7. A process for tempering the interior space of an incubator, the process comprising the steps of;

providing air feed ducts, through which a tempered gas flow is introduced ascendingly into the interior space of the incubator on both sides of a lying surface, the feed ducts being present on longitudinal sides of the lying surface;

dividing the gas flow into at least one first gas flow and a second gas flow;

individually tempering said first gas flow and said second gas flow with tempering devices associated with the gas flow; and providing the gas flows extending over predetermined longitudinal sections of the lying surface and allowing the gas flows to enter the incubator interior space.

8. The process in accordance with claim 7, wherein the section associated with said first gas flow extend from a head end to a middle of said lying surface, and the section associated with said second gas flow comprises an area from said middle of said lying surface to a foot end.

* * * * *